US012104834B2

(12) United States Patent
Khoo

(10) Patent No.: US 12,104,834 B2
(45) Date of Patent: Oct. 1, 2024

(54) METHOD, APPARATUS AND SOFTWARE FOR MONITORING AND IMPROVING THE EFFICIENCY OF A HEAT EXCHANGE SYSTEM

(71) Applicant: Cass Khoo, Alameda, CA (US)

(72) Inventor: Cass Khoo, Alameda, CA (US)

( * ) Notice: Subject to any disclaimer, the term of this patent is extended or adjusted under 35 U.S.C. 154(b) by 258 days.

(21) Appl. No.: 17/581,936

(22) Filed: Jan. 23, 2022

(65) Prior Publication Data

US 2022/0252316 A1 Aug. 11, 2022

Related U.S. Application Data

(60) Provisional application No. 63/142,454, filed on Jan. 27, 2021.

(51) Int. Cl.

| | |
|---|---|
| ***F25B 49/02*** | (2006.01) |
| ***F25B 39/00*** | (2006.01) |
| ***F25B 40/00*** | (2006.01) |
| ***F25B 41/45*** | (2021.01) |

(52) U.S. Cl.

CPC ..... *F25B 49/02* (2013.01); *F25B 39/00* (2013.01); *F25B 40/00* (2013.01); *F25B 41/45* (2021.01); *F25B 2500/09* (2013.01); *F25B 2600/07* (2013.01); *F25B 2600/2513* (2013.01); *F25B 2700/02* (2013.01); *F25B 2700/2106* (2013.01)

(58) Field of Classification Search

CPC ..... F25B 49/02; F25B 41/45; F25B 39/00; F25B 40/00; F25B 2500/09; F25B 2600/07; F25B 2600/2513; F25B 2700/02; F25B 2700/2106

See application file for complete search history.

(56) References Cited

U.S. PATENT DOCUMENTS

| | | | | |
|---|---|---|---|---|
| 2018/0017300 | A1* | 1/2018 | Shockley | F25D 21/008 |
| 2018/0106520 | A1* | 4/2018 | Wallis | F04B 49/02 |
| 2021/0041146 | A1* | 2/2021 | Bissell | F25B 49/02 |
| 2022/0146164 | A1* | 5/2022 | Long | F25B 41/31 |
| 2022/0397320 | A1* | 12/2022 | Ochiai | F25B 49/005 |

FOREIGN PATENT DOCUMENTS

| | | | | |
|---|---|---|---|---|
| CN | 110440476 A | * | 11/2019 | F25B 1/047 |

OTHER PUBLICATIONS

Pdf is translation of foreign reference CN 110440476 A (Year: 2019).*

* cited by examiner

*Primary Examiner* — Henry T Crenshaw
*Assistant Examiner* — Kamran Tavakoldavani
(74) *Attorney, Agent, or Firm* — Sumana Prabhu

(57) ABSTRACT

A method of improving the efficiency of the heat exchange system using variable superheat and sub cooling values for a wide range of ambient conditions is provided. The heat exchange system comprises an efficiency enhancing apparatus positioned between the condenser and evaporator. Data analytics software module and artificial intelligence techniques are used to obtain optimum system parameters for achieving maximum efficiency.

7 Claims, 6 Drawing Sheets

METHOD, APPARATUS AND SOFTWARE FOR MONITORING AND IMPROVING THE EFFICIENCY OF A HEAT EXCHANGE SYSTEM

CROSS-REFERENCE TO RELATED APPLICATION

This patent application claims the priority benefit under 35 U.S.C. § 119(e) of U.S. Provisional Applications No. 63/142,454 filed on Jan. 27, 2021, the contents of which are herein incorporated by reference.

FIELD OF THE INVENTION

The present invention relates generally to heat exchange systems and particularly to refrigeration and air conditioning devices. More specifically, this invention relates to cloud based and computer-implemented methods of enhancing the efficiency of a heat exchange system.

BACKGROUND OF THE INVENTION

Various devices relying on standard refrigerant recycling technologies have been available for many years, such as refrigeration and heat pump devices, having both cooling and heating capabilities. Within the limits of each associated design specification, heat pump devices enable a user to cool or heat a selected environment or with a refrigeration unit to cool a desired location. For these heating and cooling duties, in general, gases or liquids are compressed, expanded, heated, or cooled within an essentially closed system to produce a desired temperature result in the selected environment.

A typical refrigeration system has four basic components: a compressor, a condenser, an evaporator, an expansion valve and a circulating refrigerant. These components work together to quickly convert the refrigerant from gas to liquid and back again. The refrigerant to begin with, is in a gaseous state and compressed in the compressor. The compressor raises the pressure and temperature of the refrigerant gas and sends it to the condenser coil where it is converted to a liquid. In the condenser, the refrigerant vapor is liquified and then transported to the expansion valve which permits the liquid refrigerant to expand slowly into the evaporator. After evaporating into its gaseous form, the gaseous refrigerant is moved to the compressor to repeat the cycle.

The expansion valve is designed to regulate the rate at which liquid refrigerant flows into the evaporator and operates so as to maintain the superheat at a constant value that was initially set by the manufacturer. Superheat is measured as the difference between the actual temperature of the refrigerant vapor in the evaporator's exit and the saturation temperature of the refrigerant at that point. This controlled flow of refrigerant by means of the expansion valve is necessary to maximize the efficiency of the evaporator while preventing liquid refrigerant from returning to the compressor. However, at varying environmental conditions, for e.g. on a hot humid day or on a cooler day, the superheat value deviates excessively from the set value while trying to reach the set value. On a very hot and humid day, the manufacturer's preset superheat value is high, which means there is insufficient refrigerant in the evaporator for the heat load present. This could mean not enough refrigerant is entering the evaporator coil causing excessive load on the evaporator coil. As a result, the compressor becomes hot due to too little refrigerant thereby reducing the efficiency and life span of the AC system. Likewise on a cooler day, when the outside temperature is low, too much refrigerant enters the evaporator causing damage to the compressor. Therefore, in order to prevent compressor failure, in addition to the above components, the applicant has designed an efficiency enhancing apparatus for use between the condenser and the evaporator, the details of which have been described in the applicant's earlier patents (for example, U.S. Pat. No. 11,022,352B2) and are incorporated herein by reference. This apparatus enhances the condenser's efficiency especially at high temperatures and pressures when the refrigerant requires more condensing and sub-cooling. For the condenser and the efficiency enhancing apparatus to have a wide range of operating ambient temperatures, a range of superheat values is required. When the outside temperature is high, more liquid goes through the valve in order to maintain the fixed superheat preset by the manufacturer. At high ambient temperatures, the head pressure (or discharge pressure) fluctuates and increases while superheat is being kept to a preset superheat value. AC is designed to work within a range of operating temperatures and will function properly within this range. If the temperature falls outside this range i.e. too high or too low an ambient temperature, the system will be inefficient, ineffective and may damage or shorten the life of the compressor. In order for the AC to work within these extreme ranges, efficiently and effectively, the superheat has to be changed and cannot have a fixed value that is preset by the manufacturer. If the superheat is optimized for a given set of ambient conditions, then a wider range of optimized temperatures would be available for high efficiency. The present invention is a method to improve the efficiency of the AC system by fine tuning superheat and sub-cooling values for various ambient temperatures.

SUMMARY OF THE INVENTION

According to an embodiment of the invention, a cloud-based and computer implemented method of monitoring and improving the efficiency of a heat exchange system is provided. The heat exchange system comprises a compressor, condenser, evaporator, expansion valve a circulating refrigerant and an efficiency-enhancing device that is positioned between the condenser and the evaporator. The method involves the steps of receiving input data from a control box and communicating the input data to a software program in the cloud. The control box is coupled to various components of the system such as the condenser fan motor and evaporator fan motor, as well as the expansion valve. The software program in the cloud analyzes the incoming input data from the control box to determine the optimal parameters that maximize efficiency of the heat exchange system, and communicates these optimal parameters back to the control box. These optimal parameters are stored in the processor of the control box as well as in the cloud. During on-site operation of the heat exchange system, the control box communicates with the expansion valve to make the required adjustments, so as to achieve the optimal parameters for a given set of input data. In one aspect of the invention, the input data includes the indoor and outdoor ambient temperatures and humidity, the temperature, pressure and compressor power obtained from sensors on various components or devices including the compressor, condenser and evaporator. The optimum parameters include values of superheat and sub cooling temperatures for the corresponding input data.

In one embodiment, a software program for optimizing the operational parameters of a heat exchange system is disclosed. The software program comprises various modules. (1) a software module for generating input data from various devices of the heat exchange system including the condenser and evaporator for various ambient conditions that include the indoor and ambient temperature and humidity. (2) a software module for analyzing the input data to determine the optimal parameters for achieving maximum efficiency of the heat exchange system at various ambient conditions and (3) a software module for adjusting the expansion valve so as to regulate the flow of refrigerant that would correspond to the optimum values of superheat or sub cooling for maximum system efficiency.

In another embodiment, a computer implemented method to improve and monitor the efficiency of a heat exchange system is provided. The heat exchange system comprises a compressor, condenser, evaporator, expansion valve, a circulating refrigerant and an efficiency enhancing device positioned between the condenser and the evaporator. In one aspect, the method comprises the steps of receiving input data in real time from the control box coupled to the expansion valve and storing the input data in the processor of the control box as well as in the cloud system. Further, the input data is communicated to a software program. The software program retrieves previously stored optimal parameters for obtaining maximum system efficiency corresponding to the input data and then communicates the optimal parameters to the control box. The control box is configured to adjust the expansion valve as well as other components and devices including the fan motors of the condenser and evaporator, to correspond to the optimal parameters. In one aspect, the input data includes indoor and ambient temperatures and humidity, and values of temperature, pressure and power obtained from sensors on the compressor, condenser and evaporator. In one aspect, the optimum parameters include values of superheat and subcooling temperatures and compressor power for each of corresponding input data.

In yet another embodiment, a heat exchange system with improved efficiency is disclosed, the system including a compressor, condenser, evaporator, an expansion valve and a circulating refrigerant. The system comprises: (a) an efficiency enhancing apparatus positioned between the condenser and the evaporator (b) a control box coupled to the expansion valve configured to receive inputs for various ambient conditions including temperature, power and humidity. The control box is further configured to adjust the expansion valve and other associated devices of the heat exchange system to correspond to the optimal parameters. These values are obtained by means of sensors positioned on various components and devices including the condenser and evaporator. The control box communicates by direct wiring, bluetooth, WiFi or cellular methods by means of a processor within the control box, comprising a database of stored values of the optimal parameters for maximum efficiency of the heat engine. In one aspect, the input data includes temperature and pressure values obtained from the condenser and evaporator and further includes ambient temperatures and humidity. In one aspect, the optimum parameters include values of superheat and sub cooling temperatures and power for each of the obtained set of input data.

In one embodiment, a non-transitory, computer-readable medium with an executable program stored thereon, wherein the program instructs one or more processors in a control box to perform the following optimization steps: (a) receive input data from sensors on a condenser, an evaporator and a compressor of a heat exchange system comprising an efficiency enhancing apparatus. The input data includes the condenser and evaporator temperatures and pressures, the compressor power and further includes the ambient temperature and humidity (b) analyze the input data to determine the optimum values of the heat exchange system for which the compressor power and the heat exchange system power are minimum for each set of said input data and (c) store the optimal values. The program further instructs one or more processors to (1) receive input date in real time from a control box coupled to the heat exchange system; wherein said input data includes temperature, pressure and power values obtained from sensors on the condenser, evaporator and compressor and further includes ambient temperatures and humidity (2) determine the optimal values of the heat exchange system for said real-time input data values from the previously stored optimal values and (3) transmit an output signal to the heat exchange system to attain optimal values for the compressor power and heat exchange system power.

In one aspect of the invention, the efficiency-enhancing device of the present invention is a vessel having a refrigerant entrance and a refrigerant exit and comprises a refrigerant delivery tube angled to produce rotational motion of incoming refrigerant. A first disk is positioned at the entrance and within the delivery tube, and comprises an orifice within a central ring configured to allow vaporization of a portion of the liquid refrigerant. The central ring is supported by connectors connected to an outer ring to define apertures for the direct flow of refrigerant into the vessel. The vessel further comprises a means to create turbulent flow of the exiting refrigerant. In one aspect, the means for creating turbulence comprises a second disk located proximate said refrigerant exit, said second disk permitting the passage of exiting refrigerant; and one or more fixed angle blades formed in the disk, wherein said blade adds turbulence to the exiting refrigerant.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION

Figure 1:
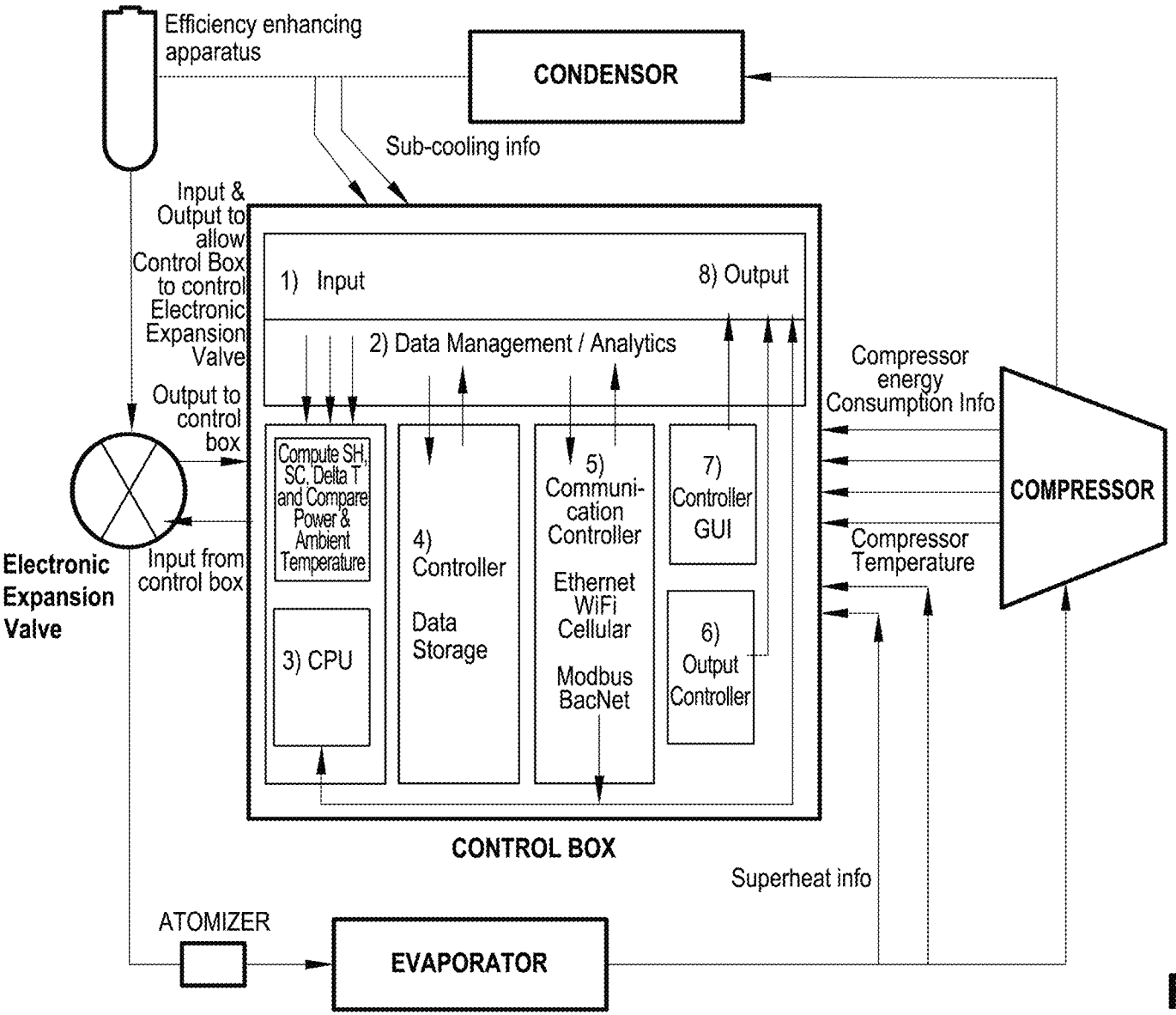
FIG. 1 shows the heat exchange system according to the invention with the various components.

This disclosure is directed to techniques to enhance the efficiency of a heat exchange system using machine learning and Artificial Intelligence techniques. FIG. 1 shows the heat exchange system with the various components including the compressor, condenser, the expansion valve and evaporator. Also shown is the Control Box connected to the expansion valve.

In addition to these basic components, the system comprises an efficiency enhancing apparatus positioned between the condenser and the evaporator, which receives a portion of the liquid refrigerant flowing from the condenser. The heat exchange system further includes an atomizer or atomizing device incorporated into the refrigerant path downstream of the expansion valve and before the evaporator coil. The atomizer preferably includes an incremental expansion device disk which develops a low pressure area on the back side. A heat exchanger on the outside of the atomizer may be used to remove any heat the expansion device captures. Alternatively, and instead of a traditional heat exchanger, heat removal can be accomplished by coating the atomizer in diamonds.

Figure 2:
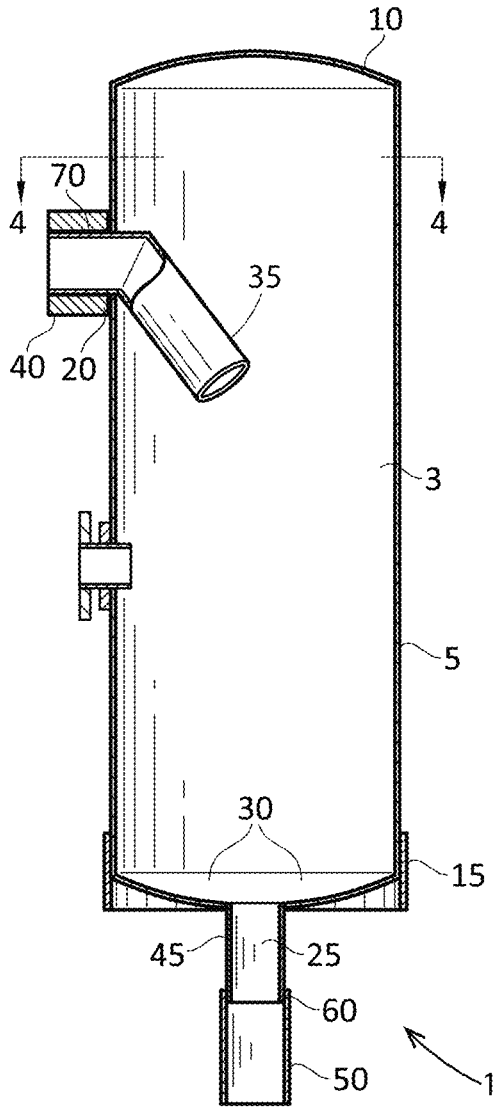
FIG. 2 shows an embodiment of the efficiency enhancing device that is positioned between the condenser and the evaporator.

FIG. 2 shows an embodiment of the efficiency enhancing apparatus of the present invention. The refrigerant entrance is located in the top region of the vessel and the refrigerant exit is located in the bottom of the vessel. Preferably, the refrigerant exit is positioned to be no lower than approximately the lowest point in the condenser. The apparatus comprises a refrigerant delivery tube 35, which is configured to generate rotational motion in the entering refrigerant. The tube 35 is located at the entrance of the vessel 1 and is angled downwards to generate rotational motion of the refrigerant within the vessel 1. Other equivalent configurations of the tube 35, that generate such a rotational refrigerant motion are contemplated to be within the realm of the invention. A disk 70, is positioned at the liquid refrigerant entrance 20 and connected to the delivery tube 35. In one embodiment, the disk comprises an orifice within a ring 73 supported by connectors to outer ring 70 to define apertures, 71. The orifice 73, at the center of the disk allows vaporization of a portion of the liquid refrigerant.

Figure 3:
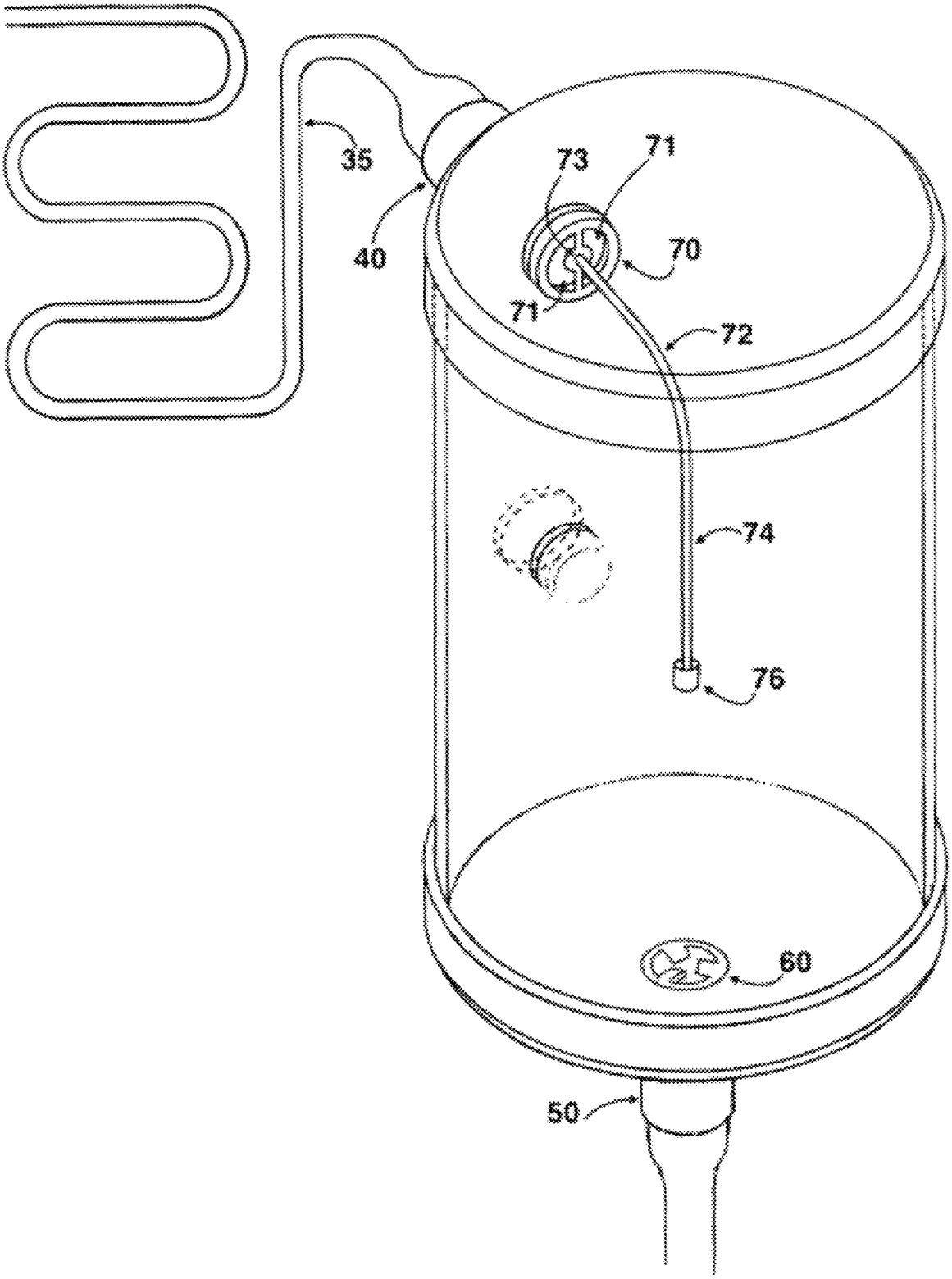
FIG. 3 shows another embodiment of the efficiency enhancing device that is positioned between the condenser and the evaporator.

In another example, a bypass tube as shown in FIG. 3 is connected to the orifice 73 of the disk 70. The disk comprises at least two apertures for the flow of refrigerant directly into the vessel and a central opening for the passage of refrigerant to the bypass tube. The bypass tube extends from the entrance into the center of the vessel and terminates in at least one bypass exit port releasing the bypass refrigerant across a heat exchanger, and reintroduces the bypass refrigerant to the refrigerant stream at the bottom of the vessel.

A disk, 60, positioned at the refrigerant exit, generates turbulence. The disk could be a turbulator comprising at least two fixed angle blades, and is positioned at the bottom region of the vessel proximate the refrigerant exit. The blades produce turbulence in the refrigerant as the refrigerant exits the vessel.

In one aspect, the efficiency may be further enhanced by the use of thermoelectric materials around the evaporator and condenser pipes. At extreme ambient temperatures, the evaporator or condenser of the heat exchange system is usually deficient in its ability to keep the refrigerant within its optimal range to reject or absorb heat effectively. In situations where the internal load is high but the ambient temperature is lower, it is possible for the vapor refrigerant to slug the compressor, damaging the compressor in the process. Conversely, in situations where the internal load is high but the ambient temperature is high, the liquid refrigerant may not be properly sub cooled, causing inefficient heat absorption at the evaporator in the process. One solution is to wrap the pipes at the evaporator or condenser with a thermoelectric material that shows Peltier Effect properties. By applying a specified direct current to the material, the desired heating or cooling can be achieved.

The heat pump disclosed herein, is designed to work with a range of superheat and sub cooling values for various ambient conditions. To begin with, and before the actual operation of the air conditioning system, an optimization procedure is performed to generate the best superheat and sub-cooling values for various ambient conditions. The ambient conditions include the indoor and outdoor temperatures, pressure, humidity, heat load and other related parameters. The superheat values are recorded from the saturation temperature and pressure data measured at the outlet of the evaporator. The sub-cooling values are obtained from the corresponding pressure and temperature data obtained from the outlet of the compressor. The input data which comprises data about the ambient conditions, the system power and temperature and pressure data from the condenser and evaporator are transmitted by sensors to a control box as shown in FIG. 1. Specialty sensors, electrical power and energy sensors may also be used to communicate with the control box. The control box computes the superheat and sub-cooling values and then analyzes, compares and processes the data to determine the optimum superheat and sub-cooling values for each set of ambient conditions for which the system power consumption is minimum. For each value of superheat and sub cooling temperatures, the corresponding compressor power is also noted. The superheat and sub cooling values that give the lowest compressor energy will be determined for various ambient conditions by means of software algorithms in the control box as well as in the cloud. Software will manage, organize, analyze and develop the optimum operational parameters needed to maximize the efficiency of the heat exchanger system. The optimum value of superheat or sub-cooling is that for which the compressor power is minimum. Thus for various ambient conditions, the system now has all the optimized data for both the superheat (SH) and sub-cooling (SC). The operation/process may be carried out for several weeks to obtain accurate values of SH and SC. The optimized data is stored in the database of the computer and in the cloud storage system. The data will be saved and later retrieved, analyzed and used by the software program when the heat exchange device is in actual operation.

Figure 4:
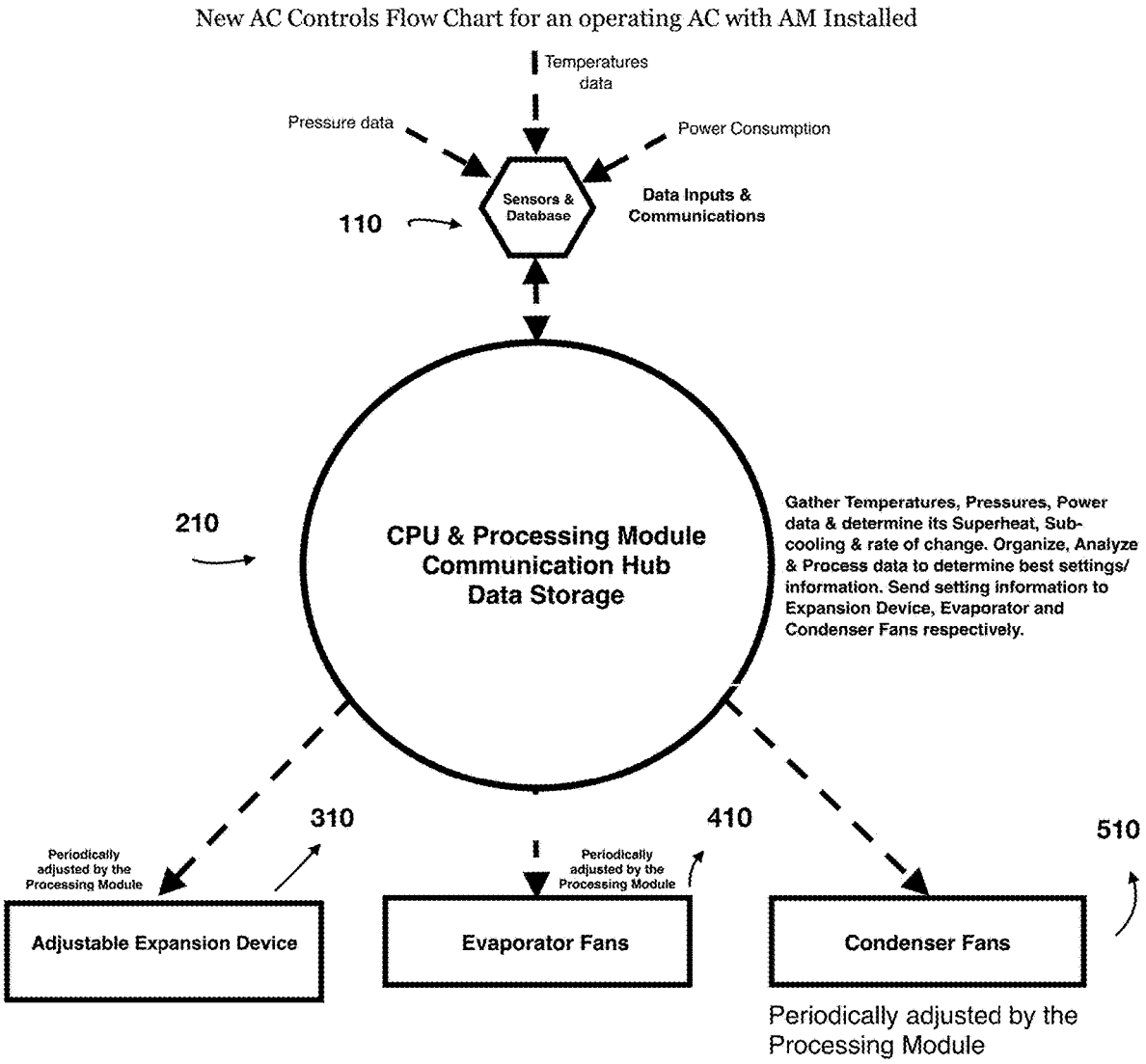
FIG. 4 is the AC controls flow chart for an operating Air-Conditioner (AC) with the efficiency enhancing apparatus installed, optimizing the superheat/sub-cooling for various ambient conditions.

FIG. 4 is the flow chart for the optimization of the superheat and sub-cooling values. The Pressure and temperature data is measured at the outlet of the evaporator to determine the superheat. Pressure and temperature data is measured at the outlet of the condenser to determine the sub-cooling. Ambient temperature data is also measured. Compressor power consumption is also recorded. Box 110 represents the input data obtained using specialty sensors, electrical power and energy sensors are utilized for these measurements. Computer Module Box, 220 then analyzes, compares and processes the data to determine the correct superheat and the correct sub cooling for each set of conditions. Database component of the Computer Model Box then sends information to adjust the expansion valve (310) and/or associated devices (410 and 510) in the heat exchanger system to obtain the optimal superheat. For each superheat value the corresponding compressor power is also noted. For a given set of ambient and load conditions, different superheat and sub-cooling values are tried out (by adjusting the expansion valve and/or associated devices in the heat exchanger system). The associated components may include the speed (RPM) of the condenser fan. The corresponding compressor power is noted. The optimum values of superheat and sub cooling are those for which the compressor power is minimum while maintaining the capacity of the heat exchange system. Thus by varying the superheat and sub-cooling, the AC cools much more efficiently and the compressor power is minimized.

During the actual operation of the AC, the software program monitors the ambient temperature and humidity and retrieves the optimized values of superheat and sub-cooling from the stored data for these conditions. When AC is in operation, the system will match the ambient conditions with the stored values of superheat and sub-cooling and adjust the system accordingly. The software module in the control box then communicates these optimum values with the adjustable expansion valve and/or associated devices in the heat exchanger system to allow the required amount of refrigerant to achieve the desired superheat values for maximum compressor efficiency. The control box communicates the data via direct wiring, blue tooth, WiFi and Cellular methods.

The software program used for optimizing the operational parameters of a heat engine/exchanger/system is stored in the control box as well as the computer and in the cloud. The software code comprises several modules. Software will manage, organize, analyze and develop the optimum operational parameters to maximize the efficiency of the heat exchange system. In one example, a data analytics software module is used for generating input data from various devices of the heat exchange system including the condenser and evaporator of the heat engine/exchange for various ambient conditions that include the indoor and outdoor temperature and humidity. In a second example, a machine learning software module is used for analyzing the input data to determine the optimal parameters for achieving maximum efficiency of the heat engine/exchanger at various ambient conditions.

Software will check for changes in the relevant environment and continue these operations repeatedly within the system and with an outside server/command center in conjunction with the Control box. In yet another example, an artificial intelligence software module is used to produce output to the control box to effect changes to reach optimal operational parameters to realize maximum efficiency. The data analytics, machine learning and artificial intelligence software programs will check the various working conditions of the components in the heat exchange system and recommend maintenance. Additionally, the software programs will check the various working conditions of the components in the heat exchange system and recommend predictive failure points.

The Machine Learning and Cognitive AI software use proprietary compilers integrated to the energy efficiency and cooling capacity optimization software and hardware to reduce energy consumption even when the heat exchanger is being fully utilized. The AI/Machine Learning solution is being deployed to enable Energy Efficiency. Existing AI/Machine Learning software known in the prior art are usually deployed for energy conservation by turning off heat exchanger system when there is no load or redirecting processed air when load is low. This form of intelligence software is to reduce energy wastage, an energy conservation effort.

Figure 5:
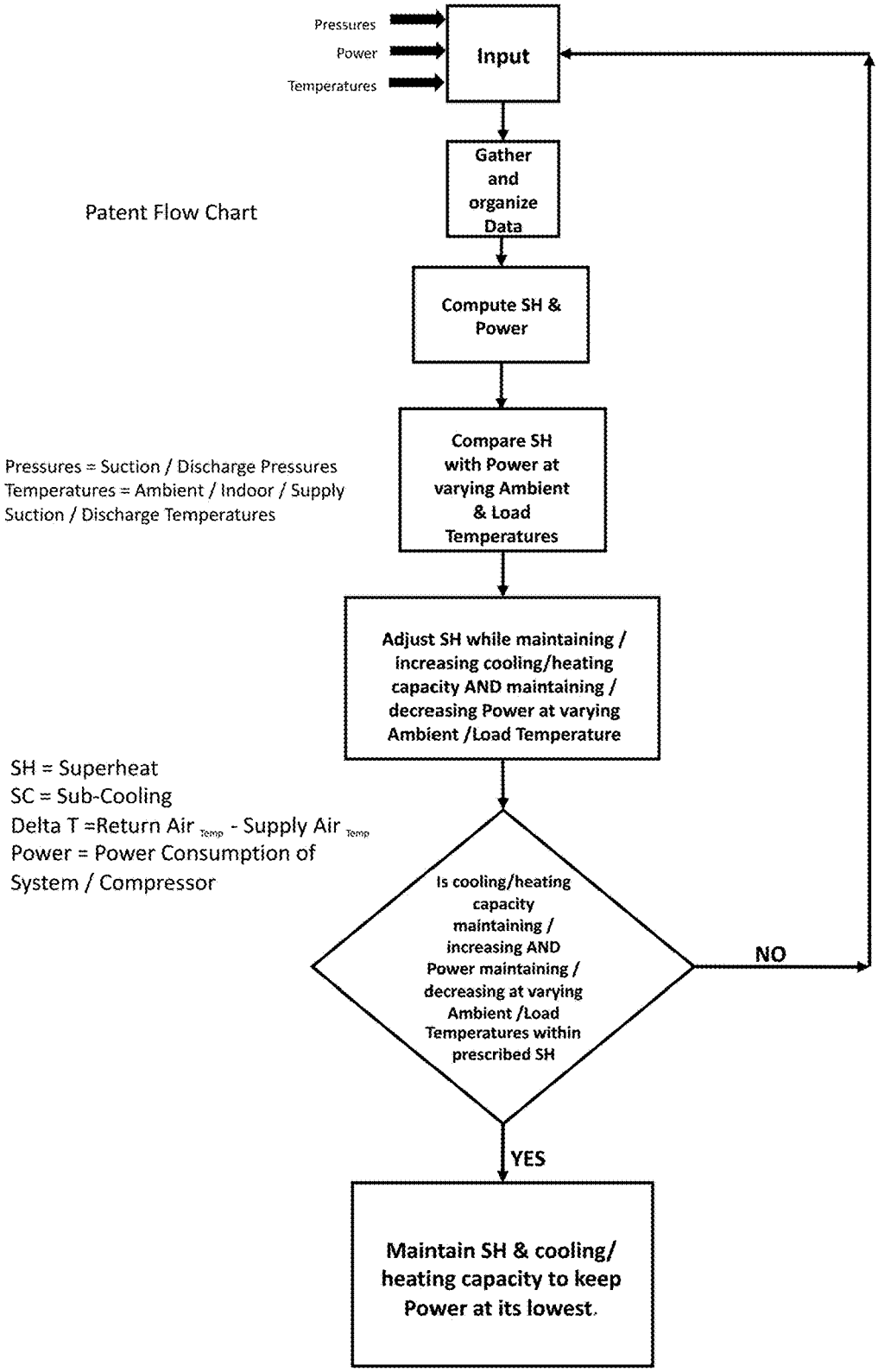
FIG. 5 is a functional block diagram of a flowchart-based programming and control system according to the invention.
Figure 6:
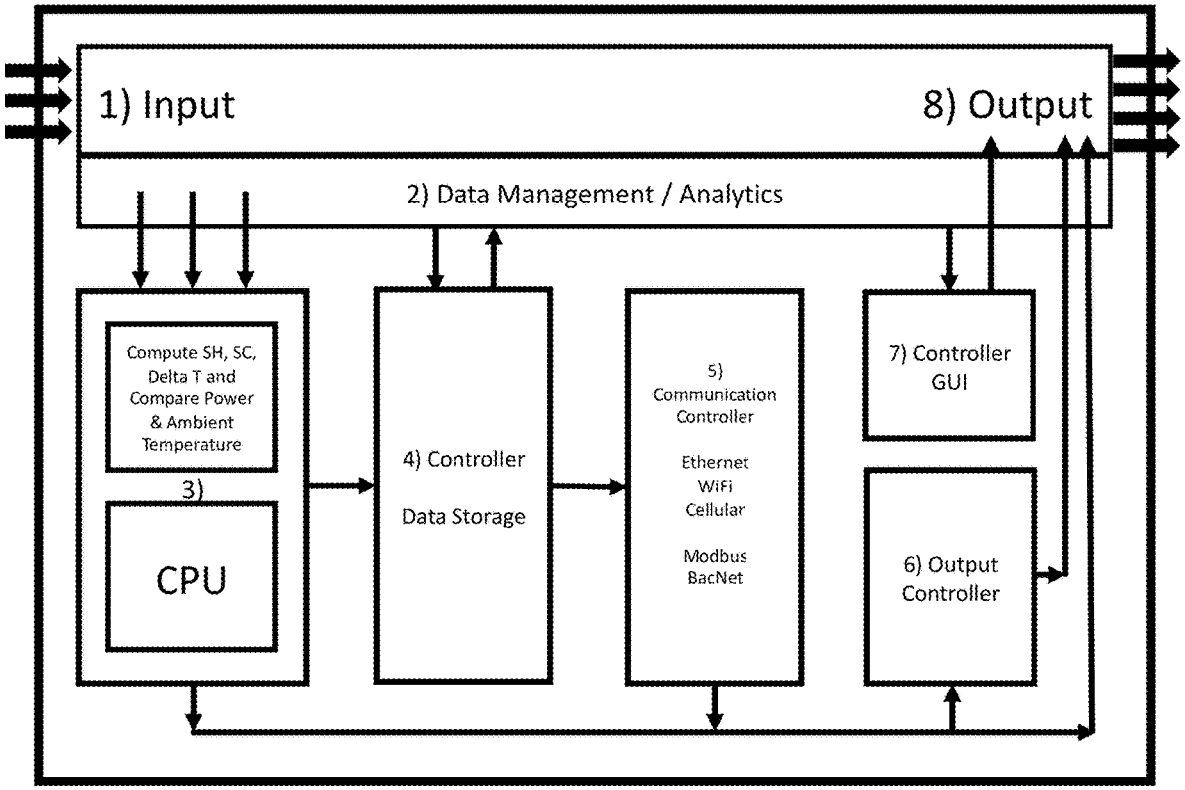
FIG. 6 shows the various components of the novel Control box according to the present invention

The steps involved in the process are shown in flow chart FIG. 5 and control Box (FIG. 6) according to the invention. The input data, 1 including the ambient temperatures, pressures and power data from pressure transducers and/sensors, temperature sensors and power sensors are gathered and organized by the Data Management and Analytics software module, 2. The superheat (SH), sub cooling (SC) and delta T are computed by the CPU (central processing unit), 3 in the control box. The SH and SC values are compared with the system power at varying ambient and load temperatures. Machine learning and artificial intelligence algorithms are used to produce output to the control box to effect changes to reach optimal operational parameters to realize maximum efficiency. The processed information is obtained and is stored in Controller unit/data storage, 4, of the control box for data management and analytics in order to facilitate optimal operational parameters for maximum efficiency during actual onsite operation of the AC. If the cooling is within prescribed superheat value while maintaining or decreasing the system power at varying ambient temperatures, then the superheat value is maintained to keep power at the lowest value. If not, the cycle is repeated again. Further, if the system power changes to a higher value, or the cooling capacity decreases, the cycle is repeated. So in each cycle, the superheat value is adjusted to ensure that the system power is minimum and highest cooling capacity is achieved. The processed information is prepared and formatted for communication and broadcast by the Communication controller, 5 in FIG. 6. The output controller (6) in FIG. 6 provides and formats processed information to the expansion valve, and the condenser and evaporator fans, to facilitate optimal operational parameters to realize maximum efficiency. The formatted and processed information is also transmitted to various mobile and stationary devices for graphical display by means of the GUI controller (7).

In one aspect of the invention, a novel control box is provided. Controllers that are being used today have limited Input/Output capabilities or have a general use in order to meet a wide range of applications and are not specific to heat exchanger systems. There does not exist a HVAC controller that has more than 8 inputs/outputs (I/Os) as a stand-alone controller. In order to have more than the usual 8 I/Os additional controllers will have to be added or connected. In addition, existing HVAC controllers do not have built-in communication capability making it necessary to purchase a separate communication bridge. Lastly, existing HVAC controllers do not have any AI/Data analytics capabilities. The control box shown in FIG. 6 has built-in communication hardwares and tools to enable easy connections for data and processed information to be transferred to the cloud, to the customers or to servers/data storage facilities. There are at least 16 inputs/Outputs within the control box for multiple type of sensors for a full range of data collection, ranging from pressures, temperatures, humidity, power, flow etc. To facilitate performance of data analytics using machine learning, the controller may also have AI on the chip and AI software within the controller.

In one aspect, the heat exchange system disclosed above allows user interface and may be remotely controlled, so that users, professional HVAC personnel or team will be able to remotely control or manage the heat exchange system. They can set levels of cooling capacity or energy savings while the heat exchange system is operating.

While the preferred embodiments of the invention have been illustrated and described, it will be appreciated that various changes can be made therein, without departing from the spirit and scope of the invention.

I claim:

1. A cloud-based method, of monitoring and improving the efficiency of a heat exchange system having a compressor, a condenser, an evaporator, an expansion valve, a circulating refrigerant and an efficiency-enhancing device positioned between the condenser and the evaporator, wherein said efficiency enhancing device is a vessel having a refrigerant entrance and a refrigerant exit, a refrigerant delivery tube angled to produce rotational motion of incoming refrigerant; a first disk positioned at the entrance and within the delivery tube, said first disk comprising an orifice within a central ring configured to allow vaporization of a portion of the liquid refrigerant; wherein said central ring is supported by connectors connected to an outer ring to define apertures for the direct flow of refrigerant into the vessel; and a means associated with said vessel to create turbulent flow of refrigerant exiting said vessel, said method comprising the steps of:

receiving input data from a control box coupled to the expansion valve; wherein said input data includes temperature, pressure and power values obtained from sensors on the compressor, the condenser and the evaporator, and further includes ambient temperatures and humidity;

communicating the input data to a software program, wherein said software program analyzes said input data to determine the optimal parameters that maximize efficiency of the heat exchange system;

communicating said optimal parameters to the control box;

storing said optimal parameters for various values of input data in the processor of the control box as well as in the cloud; wherein said control box is configured to adjust the expansion valve so as to achieve the optimal parameters for a given set of input data during on-site operation of the heat exchange system.

2. The cloud-based method of claim 1, wherein said means for creating turbulence comprises a second disk located proximate said refrigerant exit, said second disk permitting the passage of exiting refrigerant; and one or more fixed angle blade formed in said disk, wherein said blade adds turbulence to the exiting refrigerant.

3. A computer implemented method, to improve the efficiency of a heat exchange system having a compressor, a condenser, an evaporator, an expansion valve a circulating refrigerant and an efficiency enhancing device positioned between the condenser and the evaporator, wherein said efficiency enhancing device is a vessel having a refrigerant entrance and a refrigerant exit, a refrigerant delivery tube angled to produce rotational motion of incoming refrigerant; a first disk positioned at the entrance and within the delivery tube, said first disk comprising an orifice within a central ring configured to allow vaporization of a portion of the liquid refrigerant; wherein said central ring is supported by connectors connected to an outer ring to define apertures for the direct flow of refrigerant into the vessel; and a means associated with said vessel to create turbulent flow of refrigerant exiting said vessel; said method comprising the steps of:

receiving input data in real time from a control box coupled to the expansion valve; wherein said input data includes temperature, pressure and power values obtained from sensors on the condenser, evaporator and compressor and further includes ambient temperatures and humidity;

storing said input data in the processor of said control box as well as in
a cloud system communicating the input data to a software program wherein said software program retrieves previously stored optimal parameters that correspond to the input data for obtaining maximum efficiency of the heat exchange system;

communicating said optimal parameters to the control box; wherein said control box is configured to adjust the expansion valve to correspond to the optimal parameters.

4. The computer implemented method of claim 3, wherein said means for creating turbulence comprises a second disk located proximate said refrigerant exit, said second disk permitting the passage of exiting refrigerant; and one or more fixed angle blade formed in said disk, wherein said blade adds turbulence to the exiting refrigerant.

5. A heat exchange system, with improved efficiency having a compressor, a condenser, an evaporator, an expansion valve and a circulating refrigerant, said system comprising:

a) an efficiency enhancing apparatus positioned between the condenser and the evaporator;

wherein said efficiency enhancing device is a vessel having a refrigerant entrance and a refrigerant exit, a refrigerant delivery tube angled to produce rotational motion of incoming refrigerant; a first disk positioned at the entrance and within the delivery tube, said first disk comprising an orifice within a central ring configured to allow vaporization of a portion of the liquid refrigerant; wherein said central ring is supported by connectors connected to an outer ring to define apertures for the direct flow of refrigerant into the vessel; and a means associated with said vessel to create turbulent flow of refrigerant exiting said vessel;

b) a control box coupled to the expansion valve configured to receive input data from sensors positioned on the compressor, condenser and evaporator for various ambient conditions; wherein the input data includes temperature, pressure and power values obtained from the condenser and evaporator and further includes ambient temperatures and humidity; wherein said control box communicates by direct wiring, Bluetooth, Wi-Fi or cellular methods;

c) a processor within the control box, comprising database of stored values of the optimal parameters for maximum efficiency of the heat exchange system wherein the processor is further configured to adjust the expansion valve to correspond to the optimal parameters.

6. The heat exchange system of claim 5, wherein said means for creating turbulence comprises a second disk located proximate said refrigerant exit, said second disk permitting the passage of exiting refrigerant; and one or more fixed angle blades formed in said disk, wherein said blade adds turbulence to the exiting refrigerant.

7. A non-transitory, computer-readable medium with an executable program stored thereon wherein the program instructs one or more processors in a control box to perform the following optimization steps: (a) receive input data that includes values of temperature, pressure and power from a condenser, an evaporator and a compressor of a heat exchange system comprising an efficiency enhancing apparatus; where in the input data further includes the ambient temperature and humidity (b) analyze the input data to determine the optimum values of the heat exchange system for which the compressor power and the heat exchange system power are minimum for each set of said input data and (c) store the optimal values;

further said program instructs one or more processors to perform the following steps:

receive input date in real time from a control box coupled to the heat exchange system; wherein said input data includes temperature, pressure and power values obtained from sensors on the condenser, evaporator and compressor and further includes ambient temperatures and humidity;

determine the optimal values of the heat exchange system for said real-time input data values from the previously stored optimal values;

transmit an output signal to the heat exchange system to achieve optimal values for the compressor power and heat exchange system power.

* * * * *